United States Patent [19]

Giannotti

[11] Patent Number: 4,643,158

[45] Date of Patent: Feb. 17, 1987

[54] VORTEX PARTICLE SEPARATOR

[76] Inventor: Hugo V. Giannotti, 879 S. Country Rd., E. Patchogue, N.Y. 11772

[21] Appl. No.: 715,206

[22] Filed: Mar. 25, 1985

Related U.S. Application Data

[63] Continuation of Ser. No. 387,352, Jun. 11, 1982, Pat. No. 4,524,748.

[51] Int. Cl.[4] ..... F02M 33/02

[52] U.S. Cl. ..... 123/591; 55/DIG. 14

[58] Field of Search ..... 123/591; 55/DIG. 14, 55/456, 457, 396–398

[56] References Cited

U.S. PATENT DOCUMENTS

| | | | |
|---|---|---|---|
| 2,462,797 | 2/1949 | Whittaker | 55/396 |
| 3,590,560 | 7/1971 | Pall | 55/396 |
| 3,591,011 | 7/1971 | Holter | 55/396 |
| 3,915,679 | 10/1975 | Roach et al. | 55/396 |
| 4,008,059 | 2/1977 | Monson et al. | 55/396 |
| 4,158,449 | 6/1979 | Sun et al. | 60/39.092 |
| 4,238,210 | 12/1980 | Regehr et al. | 55/396 |
| 4,255,174 | 3/1981 | Simpson | 55/396 |
| 4,289,611 | 9/1981 | Brockmann | 55/457 |

*Primary Examiner*—E. Rollins Cross

[57] ABSTRACT

A device for the physical separation of particles from a gas stream consisting of a vortex particle separator containing further downstream separation and pressure loss reduction means. The device is unique in that the primary gas, instead of turning abrubtly into the discharge tube, is guided into the discharge tube by an array of louvers which act to further separate the particles from the gas stream and also to reduce pressure loss, all within the original space envelope.

1 Claim, 2 Drawing Figures

VORTEX PARTICLE SEPARATOR

This application is a continuation of application Ser. No. 387,352 filed June 11, 1982, now U.S. Pat. No. 4,524,748.

This invention relates to a device for separating a substance of a greater density from another substance, and more particularly to a device for separating solid particles from a flow of gas.

Devices for separating substances of different densities in response to inertia forces have commonly been of the centrifugal or cyclone-type of separator. Cyclone separators remove solid particles such as dust from a flow of air of other gas by subjecting the flow to a spiral-like motion during which centrifugal force urges the denser particles to move outwardly with respect to the gas in which they are suspended. Openings adjacent the outer portion of the cyclone separator remove the outer portion of the flow into which the denser particles have been concentrated.

It is an object of the invention to provide a device which can separate a substance of greater density from the flow of another substance and which is comparatively compact in relation to the quantity of flow of the substances through the device.

Another object of the invention is to provide a device for separating a substance of greater density from the flow of another substance with the minimum of pressure drop occurring during the flow of the substances through the device.

An additional object of the invention is to insure that the separating device is capable of operating efficiently over a range of flow conditions.

A further object of the invention is to provide a relatively compact device for separating dust particles from a flow of air flow with a minimum of pressure drop across the separating device.

In the embodiment of the invention, the device for separating the oversize fuel particles consists of an improved vortex separator. Reference is made to prior art on vortex separators as described in U.S. Pat. No. 4,158,449 patented June 19, 1979. The improved vortex separator contains an array of vanes or louvered slots disposed forward of the leading edge of the main air discharge tube.

Figure 1:
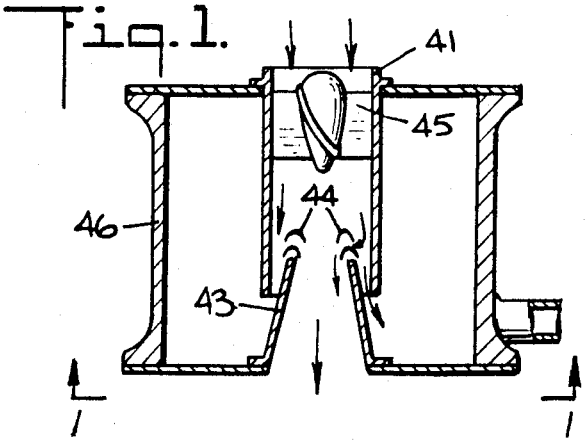
FIG. 1 is a vertical section through the embodiment of the invention showing one of an array of vortex tubes and the improvement to the vortex tube consisting of a plurality of vanes or louvered slots disposed forward of the leading edge of the main air discharge tube, and a scavenge tube leading away from the assembly.
Figure 2:
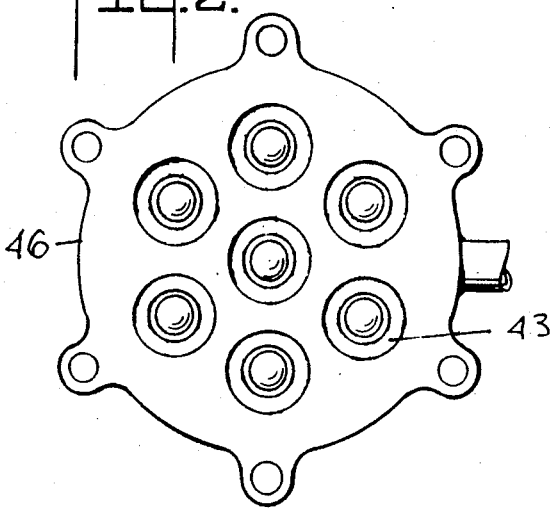
FIG. 2 is an elevational view of FIG. 1 taken along line 1—1.

The separating element shown in FIG. 1 is a vortex tube 41. In this case an improvement is shown to a typical vortex tube to increase the separating effectiveness and reduce the pressure loss of the primary flow and secondary flow. The flow of air and particles is given a rotational flow by the deflectors 45. A vortex is generated causing the heavier particles to be centrifuged towards the outside diameter. Disposed upstream of the main air discharge tube is about 50% of the area of the primary tube and since only about 10% scavenge flow is desired, a substantial amount of primary air must make an abrupt change in direction to enter the discharge tube. This increases the separation effectiveness but also increases the pressure loss. By placing turning vanes 44 in the area as shown, the mixing loss of the primary flow is reduced and consequently the overall pressure loss is reduced allowing operation at higher velocities and thereby higher separation effectiveness, or, conversely, lower velocities and reduced scavenge pressure loss for the same effectiveness. Also particle capture is enhanced by virtue of the particles having to traverse a shorter distance from vane to vane and, in so doing, are reentrained in the next flow streamline and re-accelerated so as to be able to negotiate the following vane gap and enter the capture zone.

What is clamed is:

1. In a vortex particle separator comprising, in combination, a housing having an inlet and an outlet arranged for flow therethrough of air carrying particles of different weights and, disposed in the housing across the line of air flow from the inlet to the outlet, an array of elements each having a cylindrical central passage therethrough and an inlet and an outlet at opposite ends, and deflectors adjacent the inlet for creating a vortex stream in the inlet air to concentrate heavier particles in the air at the periphery of the passage and provide a main core of air at the center of the passage containing lighter particles, and an outlet member having a central core air passage communicating with the cylindrical central passage of the tubular body and disposed within the passage at the outlet, the exterior wall of the outlet member defining a generally annular containment scavenge passage for heavy particle outlet within the cylindrical central passage of the tubular body through which pass the heavier particles, while main core air at the center of the passage passes through the central core of air passage of the outlet members; an array of turning vanes disposed upstream of the leading edge of the outlet member to cause that portion of the main core air which normally turns radially inward to the outlet member to negotiate a sharp turn radially inward into said vanes consequently depositing more of the heavier particles to the heavy particle outlet defined by said annular containment scavenge passage.

* * * * *